United States Patent [19]

Tricon

[11] 4,200,297

[45] Apr. 29, 1980

[54] SIDE ENTRY CLAMP AND PACKOFF

[75] Inventor: Alfred J. Tricon, Houston, Tex.

[73] Assignee: Sperry-Sun, Inc., Sugar Land, Tex.

[21] Appl. No.: 722,540

[22] Filed: Sep. 13, 1976 (Under 37 CFR 1.47)

[51] Int. Cl.[2] ..... F16J 15/16

[52] U.S. Cl. ..... 277/102

[58] Field of Search ..... 175/104, 105; 277/102, 277/105, 113

[56] References Cited

U.S. PATENT DOCUMENTS

| | | | |
|---|---|---|---|
| 2,355,342 | 8/1944 | Van Wormer | 175/104 |
| 3,265,398 | 8/1966 | Hansen et al. | 277/105 |
| 3,369,618 | 2/1968 | Moore | 175/104 |

*Primary Examiner*—Robert I. Smith

*Attorney, Agent, or Firm*—M. Lee Murrah

[57] ABSTRACT

Apparatus is provided for permitting a communication wireline to be suspended in a borehole along the outside of a drill stem for subsequent side entry therein and connection to a steering tool for the relaying of information from the steering tool to the surface of the borehole. The apparatus includes an apertured section of drill pipe having a self-contained sealing structure including a wireline clamp housed therein for securing and sealingly engaging the wireline therethrough and maintaining the sealed integrity of the drill stem. In this manner mud may be pumped under pressure through the drill stem to drive a drilling head while the wireline interconnects the steering tool and the borehole surface along the outside of the drill stem.

7 Claims, 10 Drawing Figures

SIDE ENTRY CLAMP AND PACKOFF

BACKGROUND OF THE INVENTION

The present invention relates to a sealing apparatus for a pressurized borehole drilling pipe, and, more particularly, to a side entry clamp and packoff for permitting the sealed and secured side entry of a communication wireline from the outside of a drill pipe section therein.

Sealing apparatus for borehole drilling operations include structures referred to as "packoff" units for sealingly engaging elements in communication with pressurized members. Such packoffs are often used in drilling apparatus where drilling mud is pumped under pressure down a drill stem to a mud motor which drives a drill bit. The mud motor drilling operation is particularly advantageous for a type of borehole construction referred to as controlled drilling wherein the drilling head is directionally controlled to drill both vertically and laterally. Similarly, various forms of packoffs have been found effective in facilitating certain aspects of controlled drilling.

Controlled drilling by its very definition generally requires directional survey information, since, in order to assure that the intended hole controlled course and destination are achieved, it is necessary to know in which direction the hole is tending at any time. The bottom hole position with respect to the top hole position can be calculated from inclination and direction readings taken from a survey tool positioned in the borehole. It is the implementation of the survey tool that frequently requires the assembly of a packoff unit in the borehole apparatus.

Survey tools have been found to be useful for all forms of drilling, whether controlled or uncontrolled, since each form of drilling is greatly affected by forces which operate upon the drilling head and tend to randomly direct the course of the borehole away from that desired. Variations and hardness of formations, in particular, may cause the course to wander since the drill bit seeks the path of least resistance. Borehole courses are also affected by their reactive torque produced by a rotating drill bit, which operates upon the length of drill pipe and tends to produce a spiral hole. These forces continually affect the drilling operation and may cause deviations from the intended course of the borehole even when the drilling is theoretically controlled. It has thus been observed that surveying of the borehole in increments during which the drilling is momentarily stopped and a survey package is lowered into the hole, is oftentimes inadequate for desired controlled drilling accuracy. Techniques have thus been developed for continuous monitoring of borehole construction facilitating true "control" in drilling.

In the past drilling has been controlled either through "conventional" or "steering" procedures. Conventional directional drilling is generally a blind process in which a hole section is begun in a particular attitude and drilled for a time thereafter without knowledge of its instantaneous attitude. Steering, on the other hand, is a continuous process in which the attitude of the hole is continuously measured in order that course corrections may be made continuously rather than after a section of the hole has been drilled. Steering is most often a technique that is used in connection with the aforesaid mud motor drilling systems, in which the drill pipe remains stationary and the drill is rotated by a mud turbine, or moyno motor, operated by high pressure drilling mud supplied from the surface. Actual steering, or deflecting capability, is provided by a deflection tool known as a "bent sub", which is a substitute section of drill pipe formed with a bend therein and positioned at the lower end of the drill string near the drill bit. The primary determinate of the angle at which the drill bit addresses the formation is the degree of bend in the bent sub. In order to turn the hole the entire drill string is merely rotated at the surface to point the bent sub in a different lateral direction.

There are four general types of attitude indicating, or steering tool, instruments adapted for positioning in the borehole to provide directional information. These instruments include the gyroscopic, inertial, magnetic and gravitational types. Gyroscopic devices utilize the direction maintaining characteristic of a rotating body, while inertial devices, such as accelerometers, sense changes in direction by the principle of inertia. Magnetic devices generally use either a magnetic compass or flux gate compass to sense the earth's magnetic field. Gravitational devices characteristically use a pendulum to sense the earth's gravity field. The position of the attitude indicating devices is detected either photographically, mechanically, electrically or magnetically. The key to steering is communicating this information to the surface, wherein the utilization of a packoff generally becomes necessary.

Attitude sensing devices operate generally in either a drilling "interrupt" or a "while" drilling mode. Generally speaking, only the devices employing electrical or magnetic sensing elements can be used in the "while" drilling mode because of the necessity of transmitting the data up the drill string to the surface. In some instances, the actual transmission from the steering tool is via acoustical transducers which alleviate cumbersome wirelines. However, in most instances where assured reliability and cost are factors for the surface to the downhole communication link, a "wireline" is preferable. Such wirelines must interconnect steering tools inside the pressurized drill stem with instruments on the surface and outside the drill stem, necessitating a packoff at some point therebetween.

A conventional and commonly utilized prior art approach to steering through attitude sensing in the "while" drilling mode includes the communication wireline, wherein a cable is threaded through a packoff unit at the surface of the borehole near the end of the drill pipe and suspended through the center thereof. The wireline, in this manner, connects the steering tool and monitoring instruments at the surface. This approach, while reliable and effective in steering the drill bit to facilitate true "controlled" drilling, creates other serious procedural and mechanical problems which are directly related to the drilling operation. For example, a cable extending through the center of the drill pipe serves to complicate the requisite drilling hardware and the procedural aspect of adding additional sections of pipe which is inherently necessary as the borehole becomes deeper. Since the cable must be fed into the borehole through the drill stem from a cable reel, or drawworks, on the surface, that end of the wireline is not readily detachable. The only feasible way found to add additional drill pipe sections has been by pulling the steering tool and downhole end of the wireline out of the drill pipe, threading it through the newest section of pipe, and dropping the steering tool and wireline back into the hole. This procedure requires a steering tool which may be readily locked and unlocked in position in the drill pipe. There is also the problem of sealing the area of interconnection where the wireline enters into the drill pipe at the surface of the borehole. The end of the drill pipe must be in sealed communication with the mud pump which forces mud into the hole under pressure for driving the mud motor and carrying off cuttings. Therefore, the wireline must enter the drill pipe through the aforesaid surface "packoff" which is expensive and further complicates the procedure of adding additional drill pipe.

The apparatus of the present invention is especially adapted for drilling with a steering system by providing for a wireline to be suspended along the outside of the drill stem and to enter and be secured therein through a side entry packoff and clamp near the drilling head. In this manner the present apparatus overcomes many of the disadvantages of the prior art by providing a wireline communication link which enters the borehole through the upwardly moving mudflow which is egressing around the drill stem rather than a surface packoff. It may be seen that the surface packoff is effectively replaced by a "downhole", side entry clamp and packoff, and, the step of pulling the wireline and steering tool out of the hole to add additional drill stem may be eliminated. Since the outside wireline may still serve to connect the steering tool with the surface monitoring equipment, the method and apparatus of the present invention permits an effective "while" drilling steering mode without the major operational disadvantages generally associated therewith.

SUMMARY OF THE INVENTION

The invention relates to apparatus for controlled drilling with a steering system which includes means for positioning a communication wireline along the outside of the drill pipe extending down into the borehole. More particularly, one aspect of the invention includes a side entry packoff positioned in a section of drill pipe with an apertured sidewall, for receiving the wireline therethrough. The apertured section is positioned above a section of drill pipe having a steering tool therein, and, communication between the surface and the steering tool may be provided through the wireline via the packoff in the drill pipe sidewall. In this manner, steering communications may be continuous during drilling operations and additional drill pipe sections may be added at the surface of the borehole without having to disconnect the wireline or pull it out of the existing drill pipe.

In another aspect, the invention includes a side entry wireline clamp and packoff for providing sealed entry and securement of a wireline in a drill pipe section disposed within a borehole. Controlled drilling with a mud motor may be provided therein and mud may be pumped under pressure down a section of drill pipe through the mud motor on the end thereof. The mud motor receives its power from the circulating mud which also picks up the drill cuttings and carries them to the surface where the mud and cuttings egress from the borehole. The packoff provides for the positioning of the wireline along the outside of the drill pipe in the borehole and an improved method of drilling with a wireline steering system. The method of drilling may be of the type disclosed and claimed in co-pending U.S. Patent Application Ser. No. 722,387, filed on 9/13/76, now abandoned, and assigned to the assignee of the present invention under the title "Method of and Apparatus for Drilling With a Steering System".

In yet another aspect, the invention includes apparatus for an improved steering system for controlled drilling of a borehole of the type wherein a steering tool is disposed within a section of drill pipe above a mud motor. The steering tool is adapted for sensing the attitude of a section of borehole and communicating the attitude information to the surface of the borehole during the operation of the mud motor. A section of drill pipe is provided with an apertured sidewall and is adapted for being positioned above the steering tool and in open-ended communication therewith. An insertable sealing unit is provided for positioning in the apertured region of the drill pipe. In this manner, a communication wireline extending from the surface of the borehole may lie along the outside of the drill pipe to the point where it extends through the apertured wall of the drill pipe section and the sealing unit therein for communicating with the steering tool contained therebelow. Communication between the surface and the steering tool may thus be provided in a manner permitting the addition and deletion of sections of drill pipe thereabove without affecting the wireline interconnection therebetween.

The sealing unit may include an expansion element for extension within a housing provided around the inner periphery of the aperture. A compressible sealing element of generally toroidal configuration may similarly be provided for circumferential engagement of the wireline and compression therearound upon extension of the expansion element providing the packoff function therefor. In like manner, a set of cable engaging jaws may be provided for rigid clamping of the cable in conjunction with the sealing element, as downhole requirements necessitate.

The side entry clamp and packoff apparatus of the present invention further facilitates a more effective and efficient controlled drilling operation. When a conventional controlled drilling operation is stopped for the purpose of adding additional drill pipe, valuable time is consumed in having to pull a wireline and steering tool on the end thereof out of the drill pipe to provide for this function. By providing means for permitting the wireline to be left in the hole along the outside of the drill pipe and secured and sealed therein, a continuous "while" drilling survey mode is not only possible but also feasible and the steering tool may never have to be affected or repositioned. Both safety and efficiency may be maintained without compromising the advantages of a full steering system.

BRIEF DESCRIPTION OF THE DRAWINGS

For a more complete understanding of the present invention, and, for further objects and advantages thereof, reference may now be had to the following description taken in conjunction with the accompanying drawings, in which.

DETAILED DESCRIPTION

Figure 1:
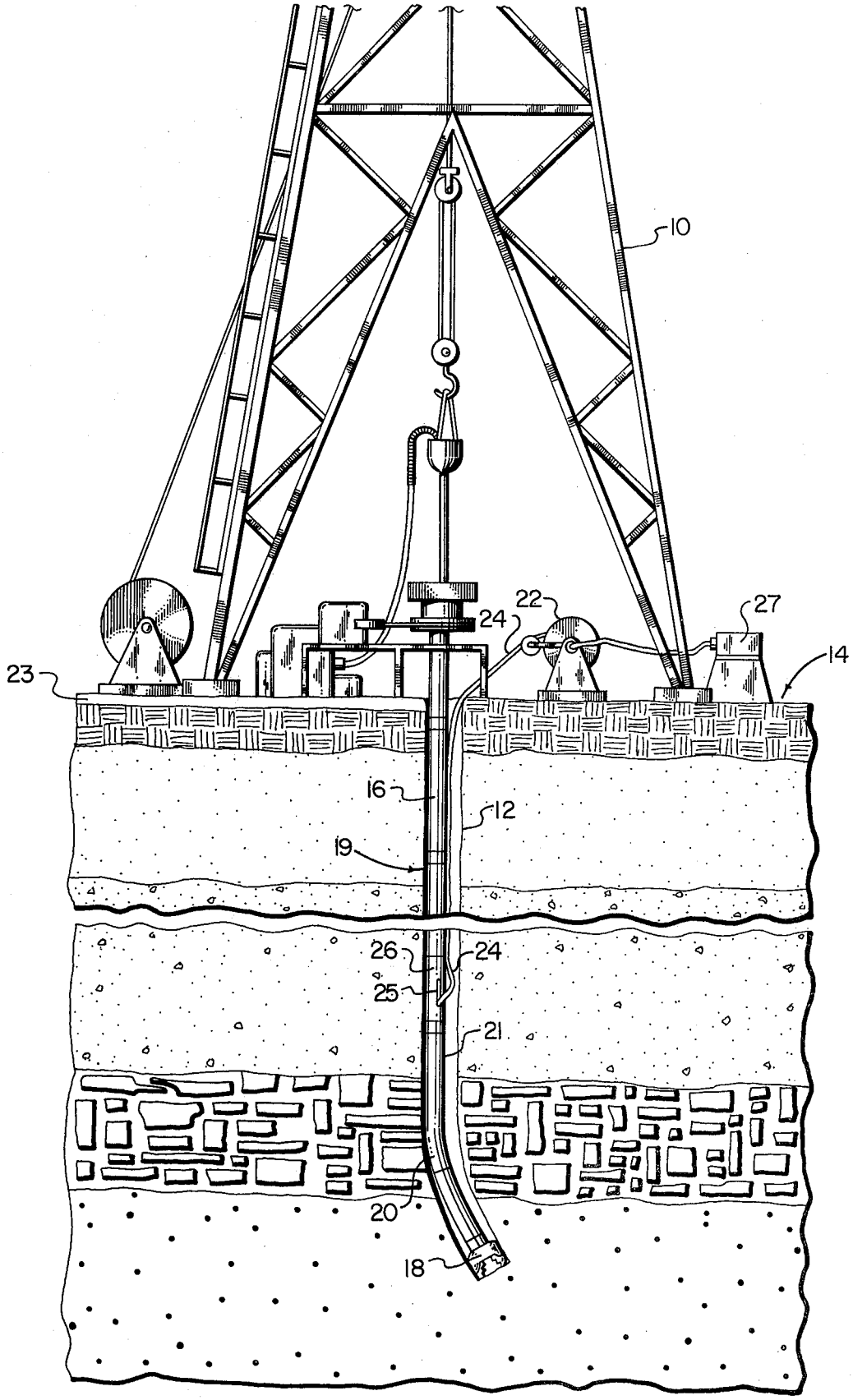
FIG. 1 is a fragmentary, cross-sectional, side-elevational view of a typical directionally drilled borehole and boring apparatus therefor, illustrating relative earth and instrument positioning and one embodiment of a method of and apparatus for drilling a borehole with a steering system constructed in accordance with the principles of the present invention.

Referring first to FIG. 1, there is shown a fragmentary, side-elevational, cross-sectional view of one type of drilling apparatus including a borehole depending therebeneath, with one embodiment of a method of and apparatus for drilling with a steering system provided therein. The drilling apparatus, as shown for purposes of illustration, includes a derrick structure 10 upstanding from a generally vertically formed borehole 12 which depends from a base surface 14 through a plurality of layers of earth therebeneath. The derrick structure 10 is shown in operational support of a type of drilling apparatus generally referred to as the mud motor variety. In such apparatus, interconnected sections of drill pipe 16 are lowered into the borehole 12 for providing viscous mud under pressure to a hydraulic motor housed therein which drives a drilling head, or bit 18, therebelow. Only the drill bit 18 rotates in the mud motor apparatus rather than an entire drill string 19 as in conventional rotary drilling systems. The mud exiting from the drill bit 18 also picks up the borehole cuttings and carries them to the surface of the borehole. A trench 23 is provided at the surface 14 for receiving the mud egressing from the borehole for recirculation. It is in this particular system of drilling that the methods and apparatus of the present invention are particularly applicable.

The drill string 19 is made up of sections of drill pipe 16 which are securely assembled and interconnected one to the other at the surface 14 before lowering into the borehole 12. The standard drill string pipe sections are generally linear, tubular structures with interconnected fittings on both ends. Certain pipe sections may, however, have specific modified configurations for providing preselected boring or operational characteristics. It may be seen that such a modified pipe section is provided in a portion of the drill string 19 comprising the angled substitute section 20, commonly referred to as the "bent sub". The bent sub is generally positioned above the drill bit 18 for providing a deflection plane which causes the drill bit to bore downwardly through, and laterally from, the theoretically vertical borehole axis. In order to control the borehole course resulting from the bent sub, means are provided for monitoring the angle of the borehole. Such means, as discussed in the background of the invention above, are commonly referred to as steering tools because they allow a steering type control at the surface 14 for determining the direction of the ongoing borehole extension. A steering tool is positioned preferably in the lower end of the drill string 19 in the general vicinity of the drilling head, as will be discussed in more detail below. It is the requisite function of communicating with the steering tool 21 from the surface 14 that provides the basis of the methods and apparatus of the present invention.

Still referring to FIG. 1, a cable reel, or drawworks 22, is shown to be provided for feeding a "surface to steering tool" communication wireline, or cable 24, into the borehole. The surface end of the cable 24 is connected to an instrument package 26 for receiving and translating the desired cable signals from the borehole 12. The lower end of the cable 24 is connected to the steering tool 21 in a manner to be discussed in more detail below. However, unlike prior art communication links between steering tools and surface equipment, the cable 24 of the present invention is provided along the outside of the drill pipe 16 rather than suspended through the center thereof. Provisions are made in the particular embodiment of the invention illustrated herein for the cable 24 to enter the drill pipe 16 near the steering tool 21 through the sidewall of a specially adapted drill pipe section. An aperture 25 may thus be seen to be formed longitudinally along the sidewall of the lower drill pipe section 26. The aperture 25 is suitably constructed to permit the cable 24 to be received therein in condition for extending through the lower drill pipe section 16 to the steering tool 21 secured therein. In this advantageous manner, the cable 24 above the drill pipe section 26 may continually lie undisturbed in the borehole 12 while additional sections of pipe 16 are added at the surface 14. Yet in conventional functional respects, the cable 24 provides the requisite communication link between surface and steering tool while utilizing the otherwise conventional steering apparatus of the wireline variety as described herein.

Figure 2:
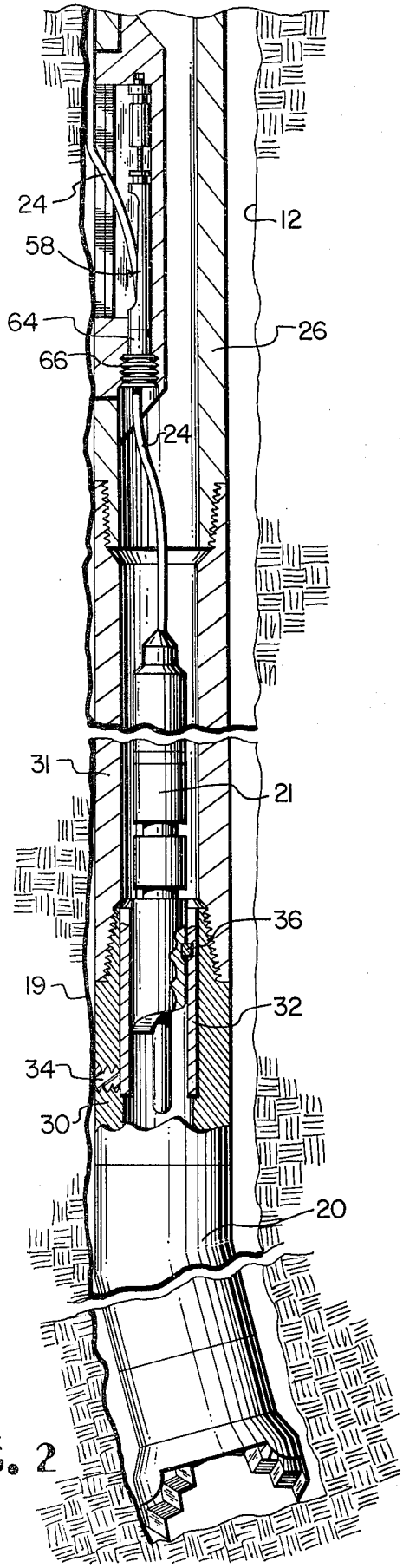
FIG. 2 is an enlarged, side-elevational, cross-sectional, fragmentary view of the section of drill pipe in the borehole of FIG. 1 illustrating the relative positioning of the steering tool wireline, and side entry packoff therefor.
Figure 3A:
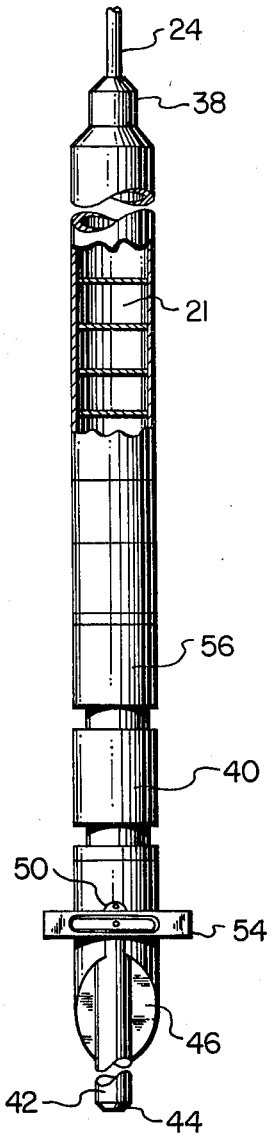
FIGS. 3*a* and 3*b* are fragmentary, front and side-elevational views, respectively, of the steering tool string shown in FIG. 2 housed within a section of drill pipe.
Figure 3B:
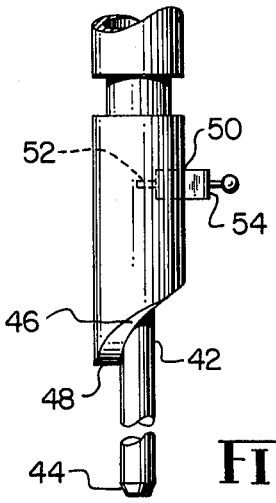

Referring now to FIG. 2 there is shown one embodiment of a side entry packoff assembled in position in a section of drill pipe, as will be discussed in detail below. It may also be seen that suitable apparatus is provided for assuring that the rotational position of the steering tool 21 and side entry packoff positioned thereabove is controllably secured. Above the bent sub 20, the drill string 19 thus preferably includes a mule shoe orienting sub 30 and non-magnetic drill collar 31. The steering tool 21 is shown positioned within the interior of the drill collar 31 and is connected at its upper end to the cable 24 which extends up, through, and out the apertured section 26 thereabove. The cable 24 therein carries signals generated in the tool 21 to the surface 14 for translation in the instrument package 27.

Mule shoe orienting sub 30 generally includes a mule shoe sleeve 33 positioned within its interior bore in a predetermined orientation. Sleeve 32 is held in the predetermined orientation with the sub by means of a screw, or the like, 34, extending through the sidewall of the sub 30. Mule shoe sleeve 32 has a key 36 positioned in its sidewall extending inwardly into the interior bore. The mule shoe sleeve and its key are normally aligned with respect to the deflection plane of the bent sub. This predetermined alignment of the mule shoe key with respect to the deflection plane of the bent sub is convenient for purposes of determining the position of the drill bit 18 with respect to the surface indications of hole deflection and providing compensating changes therein, although other alignment techniques could also be used. Mule shoe sleeve 32 has longitudinal slots (not shown) formed therein which provide a mud circulating bypass through the sleeve when the tool 21 is positioned therein. For a further detailed disclosure of a typical assembly of such a tool 21 in the aforedescribed apparatus, reference may be had to the aforementioned co-pending U.S. Patent application entitled "Method of and Apparatus for Drilling with a Steering System".

Referring now to FIGS. *3a* and *3b*, steering tool 21 is shown connected to conductor cable 24 by an adapter 38. A mule shoe 40 is preferably secured to the lower end of the drill string 21 and includes a depending shaft 42 having a tapered end 44 for the guiding thereof into mule sleeve 32. A beveled shoulder 46 preferably extends around opposite sides of the prortuding portion 42 meeting at a pointed terminal 48. On the opposite side of the tool the beveled portions 46 meet to form a longitudinally extending slot 50 sized to receive the inwardly extending key 36 on the mule shoe sleeve 32 when the tool is positioned in the drill pipe 16. As shown most clearly in FIG. *3a*, a hole 52 extends downwardly in the slot toward the center of the tool 21. Hole 52 is arranged to receive a conventional leveling device 54 which has a pin depending therefrom for insertion into the hole.

The attitude sensing element of the steering tool 21 may include a mule shoe adjuster for permitting rotation of mule shoe 40 relative to the tool string. The adjuster may include mating portions such as a conventional T-slot connector (not shown), between mule shoe 40 and tool string 21 to prevent to prevent unwanted relative rotation therebetween. A locking collar 56 may also be provided for securing tool string 21 and mule shoe 40 in a fixed relative position.

Figure 4:
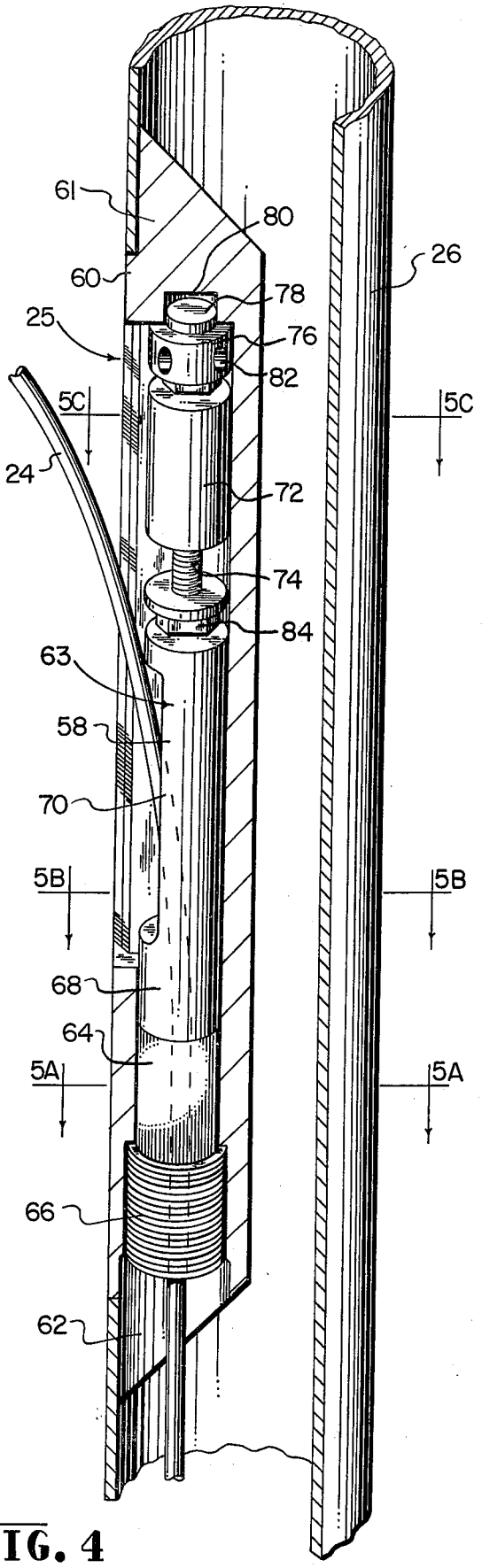
FIG. 4 is an enlarged, cross-sectional, perspective view of the apertured section of drill pipe of FIG. 2, illustrating in more detail one embodiment of a side entry, wireline packoff secured therein.

Referring now to FIG. 4 there is shown in a fragmentary, perspective cross-section the apertured region of the wall of the pipe section 26 wherein there is provided a side entry packoff 58 as shown in FIG. 2 and in accordance with one embodiment of the principles of the present invention. The packoff 58 is adapted for receiving and sealingly engaging the cable 24 as it is received through the aperture 25. The packoff 58 may be seen to provide elongated, side entry means for sealing off the elongate aperture 25 from the center of the drill pipe 16 wherein mud flows under pressure to a mud motor therebelow. It is important to the function of the mud motor drilling apparatus that the drill pipe 16 comprise a closed flow path for the mud from the surface 14 to the drill bit 18. Similarly, the flow path preferably should remain substantially unobstructed. It may be thus seen that the packoff 58 is provided along the outer wall of apertured pipe section 26 to permit a suitable flow path therebehind. Such a side entry packoff construction provides for a method of controlled drilling with a steering system as disclosed and claimed in the aforementioned co-pending U.S. Patent application.

Still referring to FIG. 4, it may be seen that the particular embodiment of the side entry packoff 58 as shown herein is comprised of an elongated, open front housing 60 wherein a separately insertable wireline sealing unit 63 is provided. The housing 60 is open through its bottom portion for providing a depending communication passage 62 between the aperture 25 and the flow section of the pipe section 26. The housing 60 is securely affixed in sealed engagement to the inside of the pipe section 26 around the inner periphery of the aperture 25 thereof, with the upper end of the housing 60 closed through an upper bulkhead 61 for providing a sealed engagement therewith.

The cable 24 may be seen to be received from the outside of the drill pipe 16 to the inside region thereof via the aperture 25 and through the sealing unit 63 which includes an elastomeric sealing element 64 positioned in the lower passage 62 of the housing 60. Underlying support of the sealing element 64 is provided by a centrally apertured bulkhead plug 66 adapted for threadably engaging the housing 60 and rigidly securing said sealing element 64 therein. Immediately above the sealing element 64 upstands an expansion structure 68 for providing the requisite wireline receiving and sealing function of the unit 58.

Still referring to FIG. 4 it may be seen that the expansion structure 68 comprises an apertured spacer 70 having a lower, centrally bored base for receiving the cable 24 therethrough and abutting the sealing element 64 therebetween. Upstanding from the spacer 70 is an extension element 72 including a threaded coupling 74 depending therefrom and engaging the spacer 70 therebeneath. The extension element 72 includes a mating head 76 having a cylindrical shoulder 78 which centrally upstands therefrom for mating engagement with a locking recess 80 formed in the upper bulkhead 61 of the housing 60. Means are provided for the rotation of the extension element 72 in relation to the stationary spacer unit 70 containing the cable 24 therein. Such rotational means preferably includes wrench holes 82 as shown to be provided in the mating head 76 thereof, which wrench holes are adapted for receiving tools for its rotation and its extension upwardly from the spacer 70. Suitable locking means are preferably provided for securing the extension of the structure 68 in the housing 60 and the resultant compression of the elastomeric seal 64, which compression seals the cable 24 extending centrally therethrough. Such locking means may include a threaded element such as lock nut 84 threadably engaging the threaded coupling 74 depending from the extension element 72 thereabove.

Figure 5C:
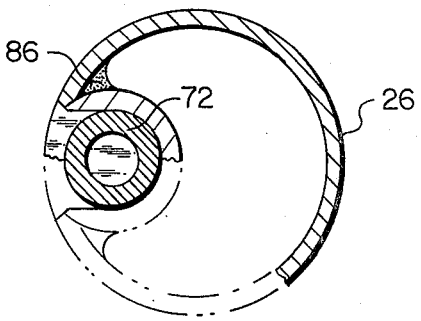
FIGS. 5*a*, 5*b* and 5*c* are cross-sectional views of the apertured section of drill pipe of FIG. 4 taken along lines 5*a*—5*a*, 5*b*—5*b* and 5*c*—5*c*, respectively, thereof, for purposes of illustrating one embodiment of the construction of the assembled wireline packoff shown therein.
Figure 5B:
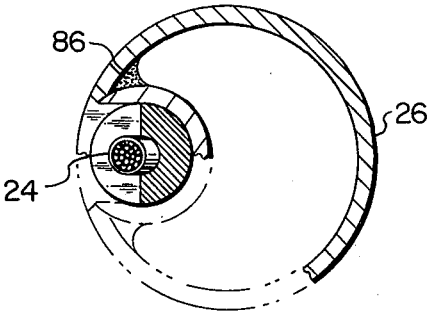
Figure 5A:
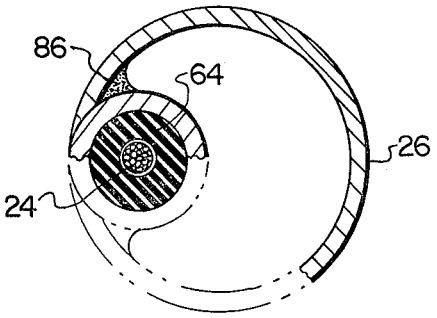

The cable receiving, sealing function of the packoff unit 58 is shown most clearly through the cross-section shown in the drawings of FIGS. *5a–5c*. As shown in FIG. *5a*, illustrating a cross-section of the elastomeric element 64, the cable 24 extending through the centrally apertured region thereof is circumferentially compressed within the sealing element 64 when said extension element 68 is expanded within the housing 60. It may also be seen in FIG. 5 that the housing 60 is securely affixed to the drill pipe 26 by brasing or the like along the outer walls thereof as shown by the fillet 86 therealong. As shown in FIGS. *5b* and *5c*, the cable 24 freely extends from the spacer 70 through the aperture 25 therealongside. The extension element 72 thereabove is similarly centrally apertured for receiving the threaded coupling 74 in the unexpanded condition which condition provides for its insertion into the housing 60 through the aperture 25. The packoff unit 58 may thus be seen to function effectively as a side entry sealing apparatus adapted for receiving the cable 24 and the extension thereof for providing the abutting engagement of the cylindrical mating head 78 and the upper bulkhead 61 of the housing 60 causing the axial compression of the sealing element 64 and the select packoff sealing.

Figure 6:
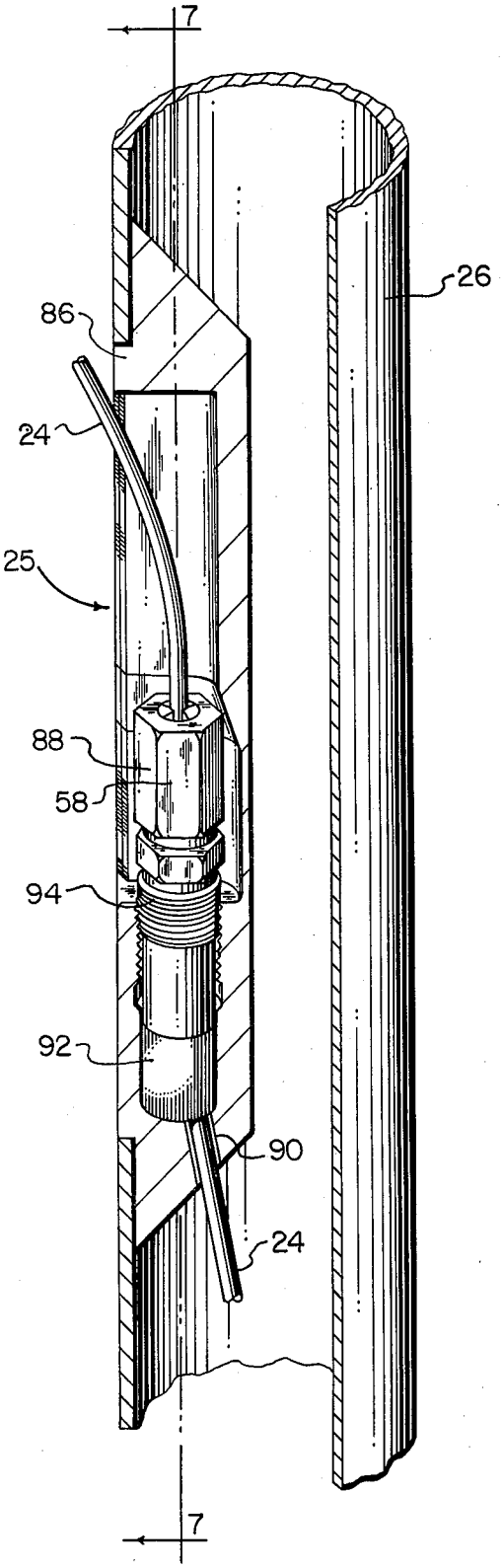
FIG. 6 is an enlarged, cross-sectional, perspective view of an apertured section of drill pipe of the type shown in FIG. 4, illustrating in more detail another embodiment of a side entry wireline packoff and clamp secured therein.
Figure 7:
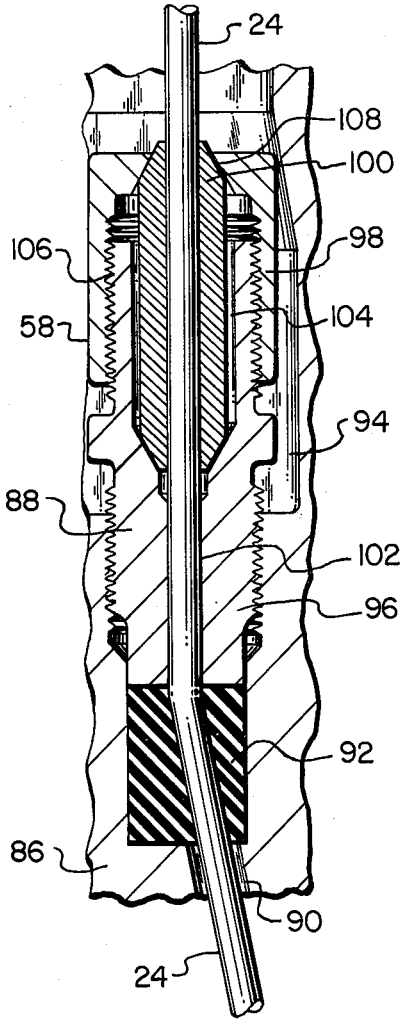
FIG. 7 is an enlarged, side elevational, cross-sectional view of the wireline clamp and packoff of FIG. 6, taken along the lines 7—7 thereof and illustrating in more detail the construction thereof.

Referring now to FIGS. 6 and 7, there is shown an alternative embodiment of the side entry packoff 58, as shown in FIG. 4 and in accordance with the principles of the present invention. The packoff 58 is similarly adapted for receiving and sealingly engaging a cable 24 as it is received through the aperture 25. It may be seen that the particular embodiment of the packoff as shown herein includes a separate wireline clamping mechanism, apart from the sealing element 64. Moreover, the sealing element is provided against a rigid bulkhead rather than a removable plug as described in more detail below.

As shown most clearly in FIG. 6, the embodiment of packoff 58 is comprised of an elongated, open front housing 86, wherein a separately insertable wireline clamping and sealing unit 88 is provided. The housing 86 is apertured through its bottom portion by passage 90. The upper and lower ends of the housing 86 are otherwise through solid bulkheads and the whole structure rigidly secured to the pipe section 26 as set forth above. In this manner a sealing element 92 may be positioned in the lower portion of the housing 86 for receiving the cable 24 therethrough in sealed engagement therewith. Sealing element 92 may be seen to be the structural equivalent of sealing element 64 of FIG. 4, but includes an off-center aperture therethrough as shown in the drawings. Immediately above the sealing element 92 upstands a compression and clamping structure 94 for providing the requisite wireline receiving, securing, and sealing function of the unit 58.

Referring now to FIG. 7, there is more clearly shown the construction of the clamping and sealing unit 88 and compression and clamping structure 94. Structure 94 is comprised of a generally cylindrical mounting body 96, threaded capping element 98 and gripping jaws 100. Mounting body 96 is centrally apertured through a lower passage 102 and an upper mouth 104, centrally aligned one to the other. Mouth 104 is adapted for receiving the gripping jaws 100 therein. The capping element 98 is similarly adapted for threaded engagement upon an upper threaded portion 106 of the mounting body 96 and abutting engagement of an upper, slanted end portion 108 of the jaws 100. The slanted ends 108 of the jaws 100, as shown herein, thus provide transverse clamping forces against the cable 24 positioned therebetween, as the capping element is rotated and secured upon body 96. In a similar manner, body 96 is secured in housing 86 through a threaded mounting therein which mounting axially compresses sealing element 92. As shown most clearly in FIG. 6, both body 96 and capping element 98 are preferably provided with hexagonal side surfaces for the requisite turning and threaded engagement thereof to provide the desired packoff function.

It may thus be seen that the method and apparatus for drilling a borehole with an outside wireline steering system may be effectively simplified by the method and apparatus of the present invention. The cable 24 is conveniently provided along the outside of the drill stem 19, entering the borehole 12 through the egressing mud flowing into the trench 23 rather than through an expensive packoff unit thereabove. The entry of the cable 24 into the drill stem 19 for connection with the steering tool 21 may be provided as desired above said tool and depending on the drilling conditions. The sealing packoff unit 58 and/or wireline clamp unit 88, being of the side entry variety facilitate both assembly and disassembly of the steering apparatus without obstructing mud flowing to the mud motor therebelow or extending outwardly of the drill stem as is often the case of conventional packoff and/or clamping units. In this manner additional sections of pipe 16 may be added or removed at the surface 14 without affecting the steering assembly or incurring disadvantageous time loss for the handling thereof.

It is believed that the operation and construction of the invention will be apparent from the foregoing description. While the method and apparatus thereof shown and described has been characterized as being preferred, it will be obvious that various changes and modifications may be made therein without departing from the spirit and scope of the invention as defined in the following claims.

What is claimed is:

1. A side entry wireline packoff comprising:

a section of drillpipe;

a wall attached to the interior of the drillpipe forming an elongate housing partially filling the annulus of said drillpipe, said housing having a first opening through the side of said drillpipe adjacent a first end of said housing and a second opening into the interior of said drillpipe on a second end thereof, said housing further having a bulkhead on the first end thereof;

a compressible sealing element positioned in said housing over the second opening in said housing, said sealing element being adapted for receiving said wireline therethrough for the sealed engagement thereof by the longitudinal compression therearound within said housing; and longitudinally expandible means positioned in said housing for engaging said bulkhead and said sealing element to compress said sealing element, thereby providing a seal between said wireline and said housing.

2. A side entry wireline packoff as set forth in claim 1 wherein said drill pipe is adapted for receiving the flow of pressurized mud therethrough for the purpose of driving a mud motor for drilling a borehole, and wherein said side entry packoff sealingly engages said wireline therein and seals off said aperture from said mud flow.

3. A side entry wireline packoff as set forth in claim 2 wherein said expandible means includes a spacer having a generally centrally apertured portion thereof for receiving said wireline therethrough and an upstanding extension portion thereabove providing for the longitudinal expansion of said structure for the concomitant abutting engagement against a portion of said housing and said sealing element therein and thereof.

4. A side entry wireline packoff as set forth in claim 3 wherein said upstanding extension portion above said spacer includes a threadably mounted member adapted to be rotated to provide the select extension from said spacer and the concomitant abutting engagement within said housing for said wireline sealing function therein.

5. A side entry wireline packoff as set forth in claim 1 wherein said housing includes a generally cylindrical, tubular structure having a closed upper end portion forming a bulkhead thereacross and a depending passage therethrough for receiving said compressible sealing element and said wireline for the sealed engagement thereof.

6. A side entry wireline packoff as set forth in claim 1 wherein said means for longitudinally compressing said sealing element includes means for clamping said wireline extending therethrough.

7. A side entry packoff as set forth in claim 6 wherein said means for clamping said wireline includes a set of jaws upwardly extending from said compressible sealing element and adapted for receiving said wireline therein for compressing engagement therewith.

* * * * *